United States Patent [19]

Spodig

[11] 4,296,865

[45] * Oct. 27, 1981

[54] MAGNETIC SEPARATOR HAVING TWO ROTATING MAGNETIC DRUMS OF OPPOSITE POLARITY

[76] Inventor: Heinrich Spodig, Netteberge 202, D-4714 Selm/Westf., Fed. Rep. of Germany

[ * ] Notice: The portion of the term of this patent subsequent to Jun. 12, 1996, has been disclaimed.

[21] Appl. No.: 24,181

[22] PCT Filed: Jul. 5, 1978

[86] PCT No.: PCT/DE78/00009

§ 371 Date: Mar. 25, 1979

§ 102(e) Date: Mar. 19, 1979

[87] PCT Pub. No.: WO79/00060

PCT Pub. Date: Feb. 22, 1979

[30] Foreign Application Priority Data

Jul. 25, 1977 [DE] Fed. Rep. of Germany ..... 2733473

[51] Int. Cl.[3] ..... B03C 1/02; B03C 1/26

[52] U.S. Cl. ..... 209/216; 209/219; 209/223 R; 210/222

[58] Field of Search ..... 209/219, 223 R, 213, 209/214, 216, 231; 210/222, 223, 2

[56] References Cited

U.S. PATENT DOCUMENTS

| | | | |
|---|---|---|---|
| 264,620 | 9/1882 | Buchanan | 209/219 |
| 449,610 | 3/1891 | Moffatt | 209/219 |
| 2,177,809 | 10/1939 | Queneau | 209/219 |
| 2,766,888 | 10/1956 | Queneau | 209/219 |
| 2,904,178 | 9/1959 | Wintermte | 209/219 X |
| 3,246,753 | 4/1966 | Launla | 209/223 R |
| 3,984,766 | 4/1976 | Spodig | 209/219 |
| 4,157,755 | 6/1979 | Spodig | 209/219 |

FOREIGN PATENT DOCUMENTS

| | | | |
|---|---|---|---|
| 943761 | 5/1956 | Fed. Rep. of Germany | 209/219 |
| 967761 | 11/1957 | Fed. Rep. of Germany | 209/219 |
| 1160212 | 8/1957 | France | 209/213 |

*Primary Examiner*—Robert Halper

[57] ABSTRACT

A magnetic separator having two rotating magnetic drums of opposite polarity which form between them a working air-gap, and having directionally magnetized block magnets on each side of both end-faces of the magnetic drums in a closed magnetic circuit, the magnets being connected together on one side of their poles, in pairs with unlike poles, by means of soft-iron parts, and being provided, on the other side, with pole shoes in which are mounted soft-iron parts designed as axes, the drums each being arranged in a housing comprising slide plates which are located in the working air-gap and which converge at the inlet and diverge at the outlet, the said drums comprising axial grooves distributed radially around their peripheries, or having peripheries of star-shaped cross section.

1 Claim, 4 Drawing Figures

MAGNETIC SEPARATOR HAVING TWO ROTATING MAGNETIC DRUMS OF OPPOSITE POLARITY

The present invention relates to a magnetic separator having two rotating magnetic drums of opposite polarity, forming between them a working air-gap.

Magnetic-drum separators for separating fine and very fine particles, especially weakly mangetizable particles, from bulk material of all kinds, are known (German Pat. No. 943 761). Separators of this kind have, within each drum, stationary magnets forming, by means of a common yoke outside the drums, a magnetic system common to both drums, the field of force thereof extending across the gap between the drums. In systems of this kind, not only are there large scatter losses at the working air-gaps, but also uncontrolled scatter, outside the effective area, from the working gaps to other components. The result of this is that the separated material closes the gaps and cause shutdowns, unless cleaning is carried out regularly.

It is the purpose of the invention to obtain better efficiency by keeping the external scatter fields as small as possible and by avoiding as far as possible, any scatter outside the effective area.

According to the invention, and in the case of a magnetic separator of the type mentioned at the beginning hereof, it is proposed to achieve this purpose in that, arranged on each side of the end faces of the magnetic drums, in a closed magnetic circuit, are two directionally magnetized block magnets which are connected together, on one side of their poles, in pairs with unlike poles, by means of soft-iron parts, and which are provided, on the other side, with pole shoes in which are mounted soft-iron parts, designed as axes, each of the said drums being arranged in a housing comprising sliding plates which are located in the working air-gap and which converge at the inlet and diverge at the outlet, the said drums having axial grooves distributed radially around their peripheries, or having peripheries of star-shaped cross section.

The result of this is a closed system which has substantially less scatter than known arrangements, which largely eliminates external scatter, and which provides a more intense magnetic field in the working air-gap.

The slide plates preferrably form parts of the drum housing. It is desirable to design the soft-iron parts in the interior of the drums in such a manner that they are of segmental or cylindrical cross section, and to arrange them upon an axis.

The object of the invention is explained hereinafter in greater detail, in conjunction with the examples of the embodiment illustrated in the drawing, wherein.

Figure 1:
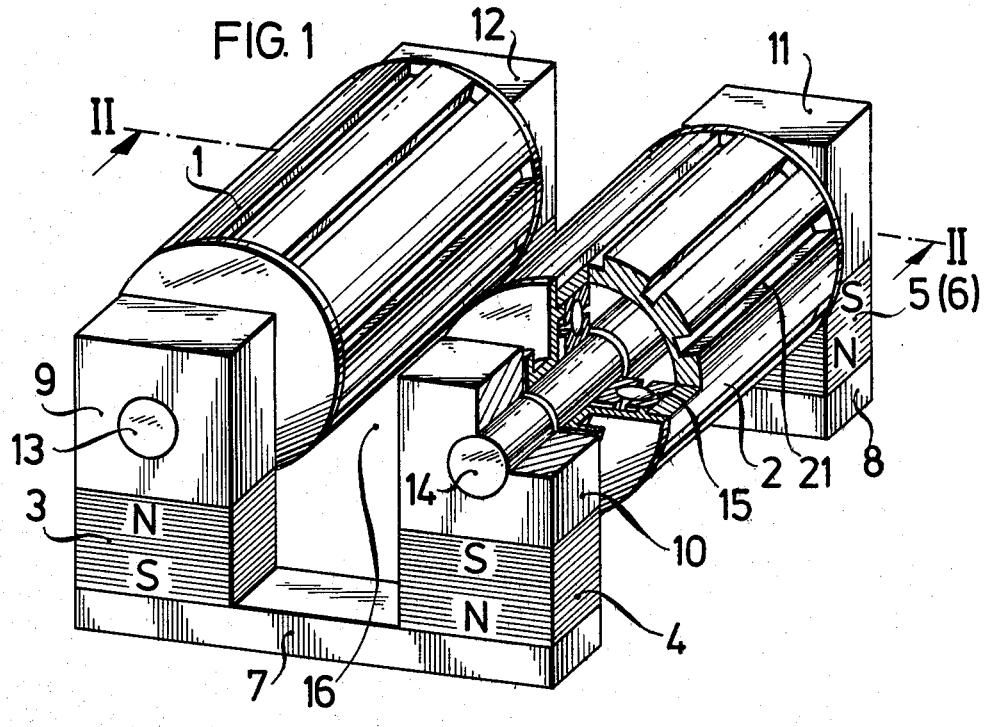
FIG. 1 is a diagrammatic representation, in part section, of the magnetic separator without its housing.

According to FIG. 1, the magnetic separator consists of two magnetic iron drums 1, 2 and a magnetic system consisting of block magnets 3,4 and 5,6 arranged on each side of the end-faces of magnetic drums 1,2 the said magnets being connected together, on one side of their poles, in pairs with unlike magnet poles, by means of soft-iron parts 7,8 and comprising pole shoes 9, 10 and 11, 12 on the other side of the poles. Mounted in the ball-bearings 15 in pole shoes 9,10 and 11,12 are soft-iron parts designed as axes 13 and 14 for rotating magnetic drums 1 and 2. Soft-iron parts 7 and 8 on the one hand, and pole shoes 9,10 and 11,12 and axes 13 and 14, on the other hand, provide an absolutely closed circuit for the magnetic flux of block magnets 3,4 and 5,6, the effective magnetic field, and working air-gap 16, being located in the gap between magnetic drums 1 and 2.

Magnetic drums 1 and 2 are arranged respectively in housings 17 and 18. Located in working air-gap 16 of housings 17 and 18 are slide plates 19,20 which together form a converging inlet and a diverging outlet on each side of drums 1 and 2 which they partly surround.

Figure 3:
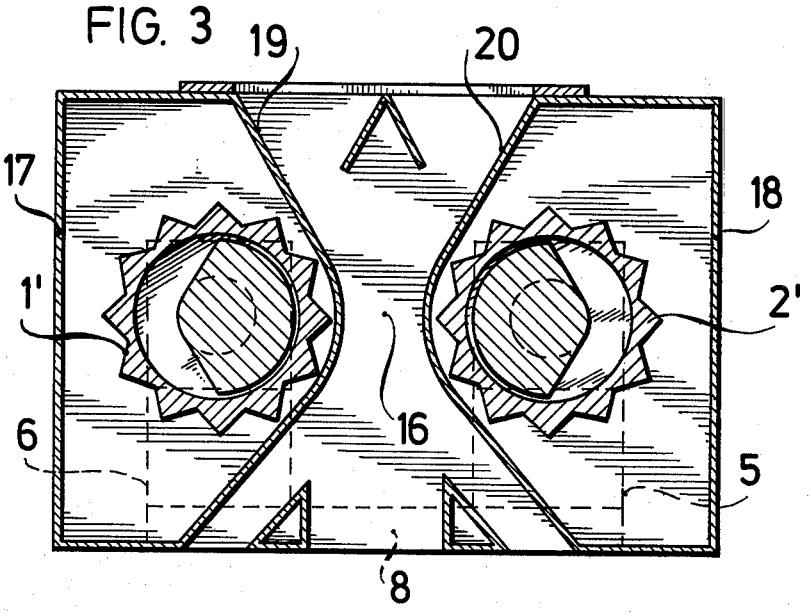
FIG. 3 is a section through the magnetic separator with its housing, along the line II—II in FIG. 1, but with drums and axes of rotation of a different design.
Figure 4:
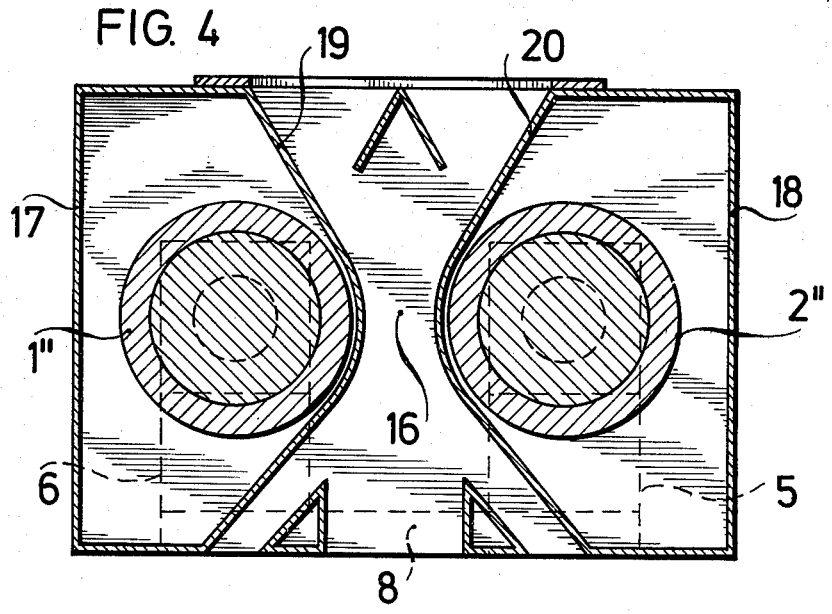
FIG. 4 is a section through the magnetic separator, with its housing, along the line II—II in FIG. 1, with a further modification of the design of the drums and axes.

Magnetic drums 1 and 2 have axial grooves 21 distributed radially around their peripheries and filled with non-magnetic material; or as shown in FIG. 3 they may be of star-shaped cross section.

Figure 2:
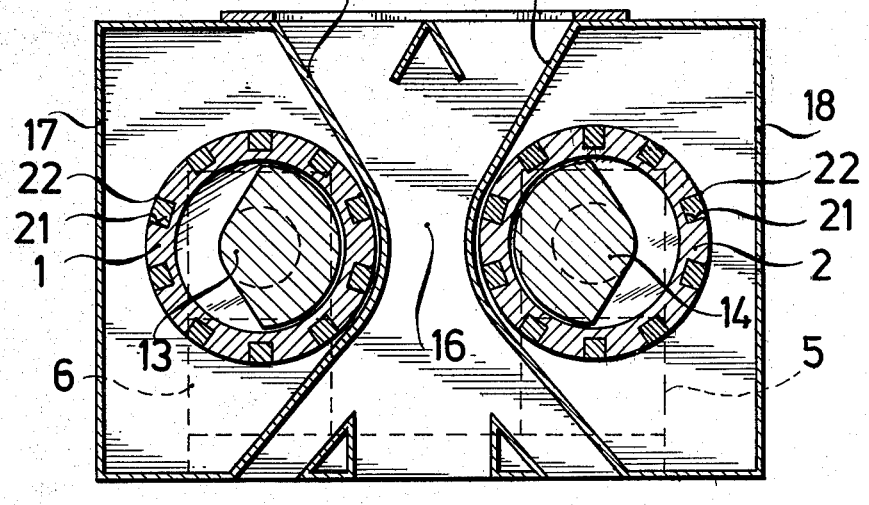
FIG. 2 is a section through the magnetic separator with its housing, along the line II—II in FIG. 1.

Edges 22 (FIG. 2), thus formed, provide an intensified magnetic emission which considerably improves the separating action in working air-gap 16, formed by slide plates 19 and 20, through which the material to be separated pass from top to bottom. In order to increase still further the magnetic flux in working air-gap 16, axes 13 and 14 are of segmental or cylindrical cross section over the length of magnetic drums 1 and 2.

I claim:

1. A magnetic separator comprising the combination of two rotatable magnetic drums of opposite polarity forming a working air-gap therebetween, each said drum including a plurality of grooves distributed in a radial direction around their peripheries and extending in an axial direction, said combination further including two directionally magnetized block magnets arranged on each side of said magnetic drums, said drums being arranged in a housing comprising a pair of slide plates positioned in the working air-gap, said plates converging at the inlet and diverging at the outlet, said block magnets being disposed in a closed magnetic circuit and being connected in pairs at the bottom part of their poles of unlike polarity by means of soft-iron parts, said block magnets having on the upper side of their poles of unlike polarity a pair of axially spaced apart pole shoes in which soft-iron parts are disposed and which last mentioned soft-iron parts serve as the axles for said rotatable magnetic drums.

* * * * *